US007377812B2

(12) United States Patent
Fukushima et al.

(10) Patent No.: US 7,377,812 B2
(45) Date of Patent: May 27, 2008

(54) ELECTRICAL CONNECTOR

(75) Inventors: Takeshi Fukushima, Tokyo (JP); Tsuyoshi Sakata, Tokyo (JP)

(73) Assignee: Hicose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/516,655

(22) Filed: Sep. 7, 2006

(65) Prior Publication Data

US 2007/0054556 A1 Mar. 8, 2007

(30) Foreign Application Priority Data

Sep. 8, 2005 (JP) ..... 2005-261163

(51) Int. Cl.
*H01R 13/648* (2006.01)

(52) U.S. Cl. ..... 439/610; 439/607

(58) Field of Classification Search ..... 439/101, 439/108, 607, 610
See application file for complete search history.

(56) References Cited

U.S. PATENT DOCUMENTS 3,609,630 A * 9/1971 Francis ..... 439/106
4,682,840 A * 7/1987 Lockard ..... 439/874
5,201,675 A * 4/1993 Igarashi et al. ..... 439/607
5,921,814 A * 7/1999 Maruyama ..... 439/607
6,066,000 A * 5/2000 Masumoto et al. ..... 439/607
6,315,616 B1 * 11/2001 Hayashi ..... 439/638
6,454,606 B2 * 9/2002 Igarashi ..... 439/610
6,890,193 B2 * 5/2005 Kimura et al. ..... 439/108
7,074,075 B2 * 7/2006 Miyazawa ..... 439/499

FOREIGN PATENT DOCUMENTS

JP 2001307822 11/2001

* cited by examiner

*Primary Examiner*—Tho D Ta
*Assistant Examiner*—Travis Chambers
(74) *Attorney, Agent, or Firm*—Kubotera & Associates LLC

(57) ABSTRACT

An electrical connector to be connected to a cable includes a first housing having a casing with a substantially rectangular shape and a fitting section protruding from the casing in a direction that the electrical connector is fitted to a mate connector; a first shell covering the casing; and a first terminal arranged in the fitting section. The first terminal has contact sections at upper and lower sides of one end thereof for contacting with a terminal of the mate connector, and a connecting section at the other end thereof for connecting with a core wire of the cable. It is arranged such that a distance from the contact section at the upper side to the connecting section is substantially same as a distance from the contact section at the lower side to the connecting section.

8 Claims, 12 Drawing Sheets

ELECTRICAL CONNECTOR

BACKGROUND OF THE INVENTION

1. Field of the Invention

The present invention relates to an electrical connector of a low-profile mounting type for connecting a cable to a board.

2. Description of Related Art

For example, Japanese Patent Publication No. 2001-307822 discloses an electrical connector of a low-profile mounting type. In this type of electrical connector, high frequency characteristics are required. It is also necessary to reduce a size of a connector, especially a height thereof, to achieve a low-profile design.

In order to meet the requirements, in a conventional connector, a terminal includes a one-point contact. However, the one-point contact tends to cause a reliability problem. Further, when a conventional connector achieves a low-profile design, a receptacle thereof tends to have low strength against a fitting operation relative to a mate connector, i.e., a plug. As a result, when the connector is fitted to a mate connector, a fitting opening tends to be deformed, thereby deteriorating contact reliability.

In order to satisfy the high-frequency characteristics, in a conventional connector, a ground terminal is provided in addition to a shell. However, when the ground terminal is provided, a structure of the connector tends to become complicated, and it is difficult to maintain flatness of a soldered portion.

As shown in FIG. 12, when a core wire of a fine coaxial cable is soldered to a plug of a conventional electrical connector, a molded wall 90 is provided for guiding a cable core 11 provided at an end of a coaxial cable 10. However, depending on work precision, a heater tip 91 or a soldering iron may touch and melt the molded wall 90, thereby causing poor workability.

Moreover, in a conventional plug-receptacle structure, a guide portion of a connector for guiding a mate terminal is made of a resin. Accordingly, when a plug is fitted to a receptacle, the mate terminal may damage the guide portion of the connector to generate a resin dust, thereby deteriorating contact reliability.

Patent Reference: Japanese Patent Publication No. 2001-307822

In view of the problems described above, an object of the invention is to provide an electrical connector with improved contact reliability of a terminal while achieving good high-frequency characteristics and a low-profile design. Further, it is possible to increase strength of a fitting opening, maintain flatness, and improve workability of soldering a core wire.

Further objects of the invention will be apparent from the following description of the invention.

SUMMARY OF THE INVENTION

In order to attain the objects described above, according to the present invention, an electrical connector to be connected to a cable includes a first housing having a casing with a substantially rectangular shape and a fitting section protruding from the casing in a direction that the electrical connector is fitted to a mate connector; a first shell covering the casing; and a first terminal arranged in the fitting section. The first terminal has contact sections at upper and lower sides of one end thereof for contacting with a terminal of the mate connector, and a connecting section at the other end thereof for connecting with a core wire of the cable. It is arranged such that a distance from the contact section at the upper side to the connecting section is substantially same as a distance from the contact section at the lower side to the connecting section.

According to the present invention, the electrical connector may include a guide slit at the connecting section of the first terminal for positioning the core wire of the cable.

According to the present invention, in the electrical connector, the first terminal may be formed by folding so as to have a folded section at the one end, or may be formed in an integrated single piece.

According to the present invention, in the electrical connector, the first terminal may include an upper contact section and a lower contact section at the one end formed by folding. The first terminal and the first housing may be integrally formed as a single piece such that a gap between the upper contact section and the lower contact section is filled with a resin.

According to the present invention, in the electrical connector, the first terminal may include both side edges in the direction that the electrical connector is fitted to the mate connector, and the both side edges are embedded in a resin of the first housing.

According to the present invention, in the electrical connector, the first shell may include a portion extending toward a fitting side to the mate connector. The portion has a ground surface for grounding with a shell of the mate connector.

According to the present invention, an electrical connector to be connected to a board includes a second housing with a substantially rectangular shape having a fitting opening for fitting to a mate connector; a second shell covering the second housing and opening at least the fitting opening; and a second terminal arranged inside the second housing. The electrical connector has contact sections on upper and lower sides thereof for contacting with a terminal of the mate connector.

According to the present invention, in the electrical connector, the fitting opening of the second shell may include edges bent upward and downward toward the fitting opening, respectively.

According to the present invention, in the electrical connector, the second shell may include a portion folded toward inside the fitting opening to the mate connector and having a free end for grounding with a shell of the mate connector.

According to the present invention, a terminal disposed in an electrical connector to be connected to a cable includes a first terminal having contact sections at upper and lower sides of one end thereof for contacting with a terminal of a mate connector and a connecting section at the other end thereof for connecting with a core wire of the cable. The connecting section of the first terminal has a guide slit for positioning the core wire of the cable.

With the electrical connector of the invention, it is possible to improve contact reliability of the terminal while achieving good high-frequency characteristics and a low-profile design. Further, it is possible to increase strength of the fitting opening, maintain flatness, and improve workability of soldering the core wire.

DESCRIPTION OF THE PREFERRED EMBODIMENTS

Hereunder, embodiments of the present invention will be explained with reference to the accompanying drawings.

According to the present invention, an electrical connector includes a pair of connectors, i.e., a connector to be connected to a cable (a plug connector) and a connector to be connected to a board (a receptacle connector). The plug connector can be fitted to the receptacle connector so as to freely attach/detach.

Figure 1:
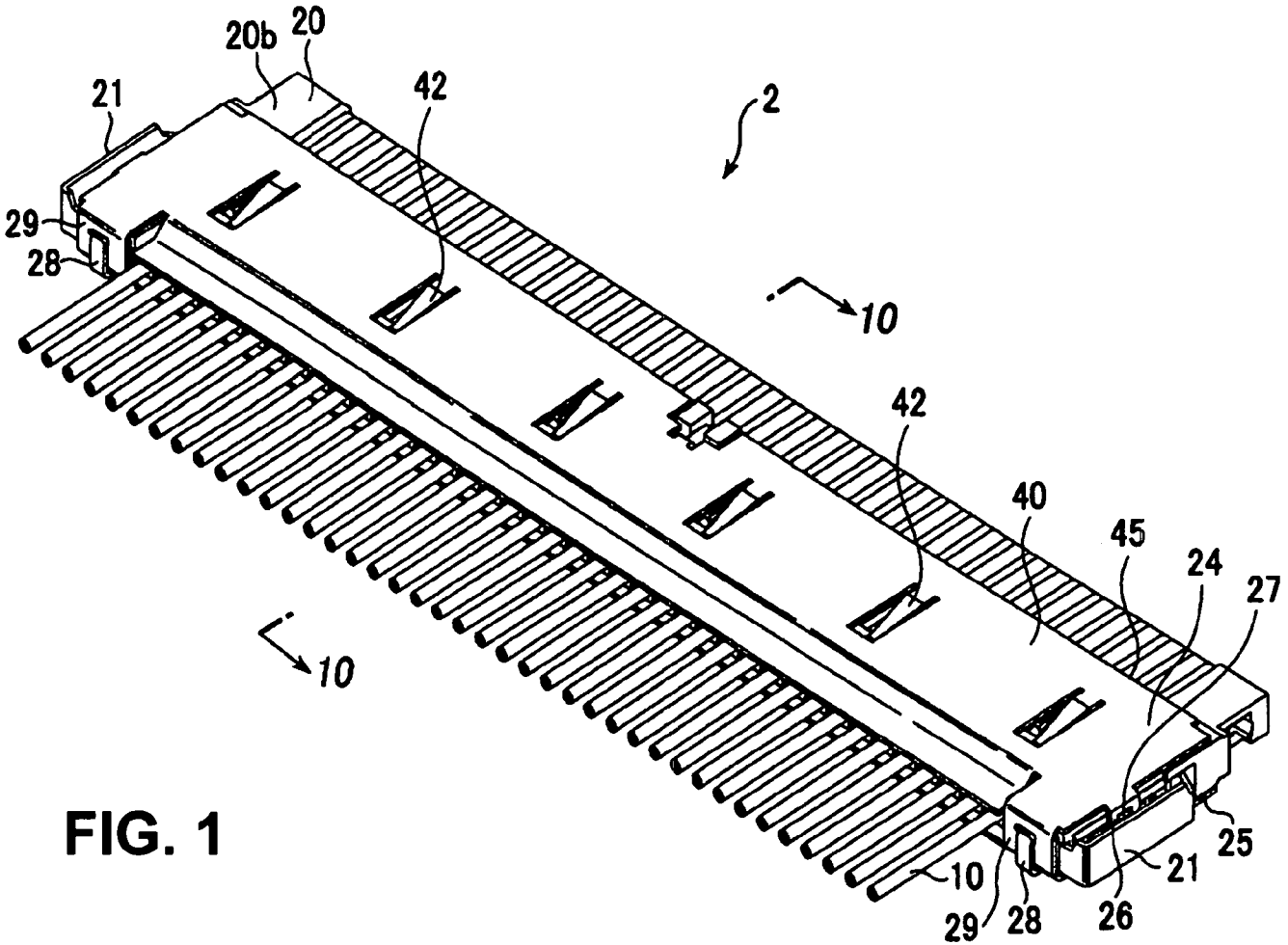
FIG. 1 is a perspective view showing an upper surface of a plug according to an embodiment of the present invention.
Figure 2:
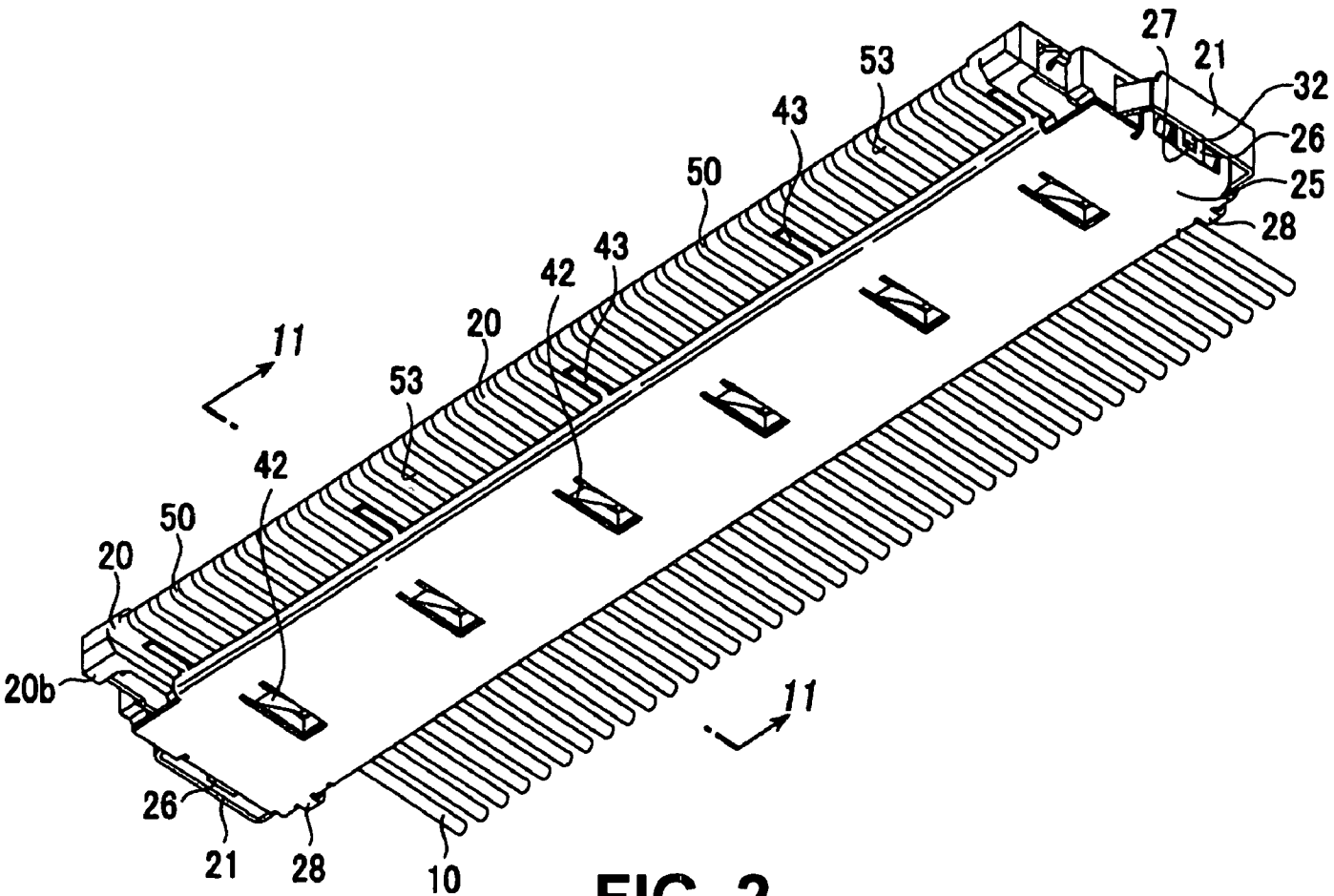
FIG. 2 is a perspective view showing a bottom surface of the plug according to the embodiment of the present invention.
Figure 3:
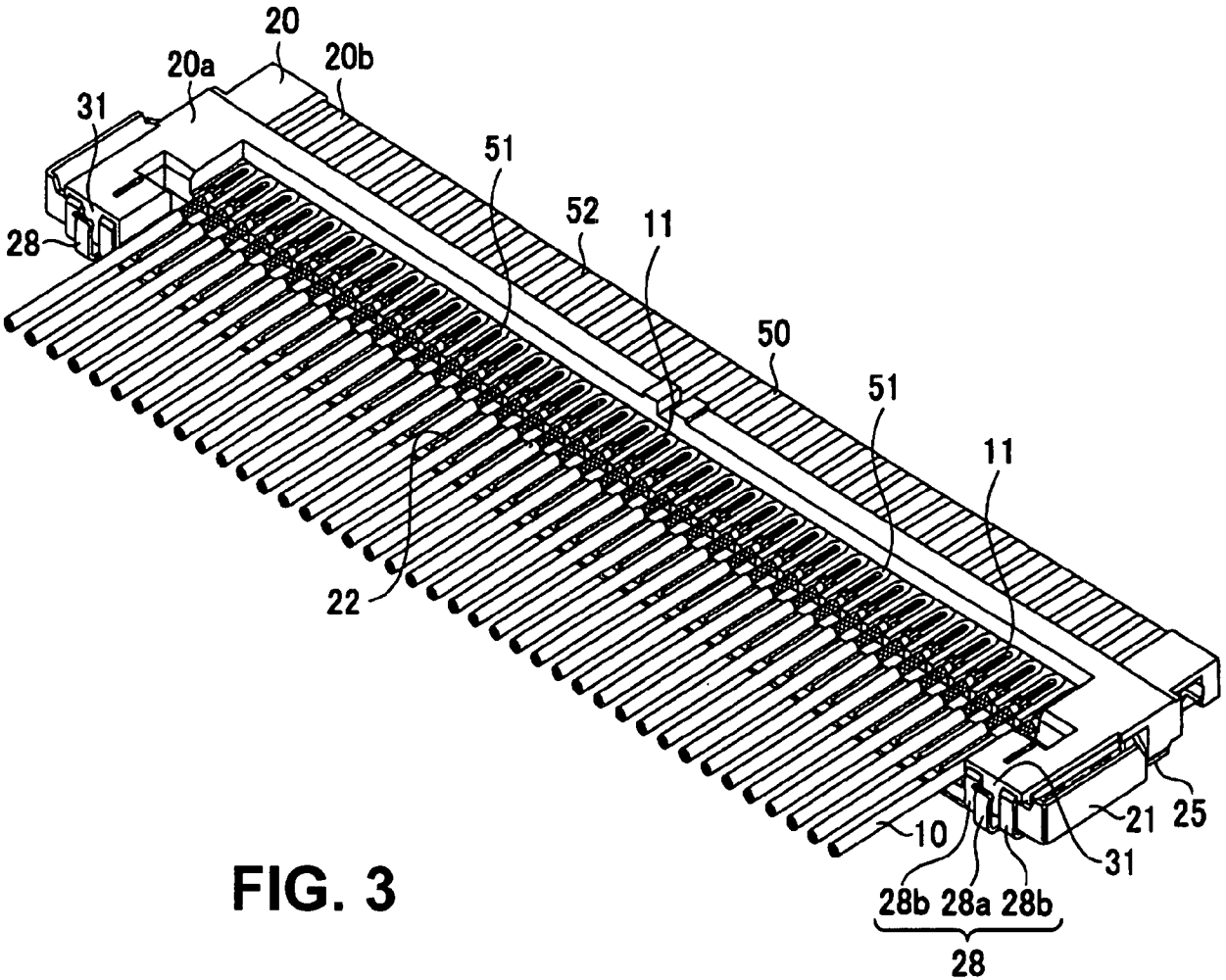
FIG. 3 is a perspective view showing the plug shown in FIG. 1 in a state that an upper plug shell is removed.
Figure 4:
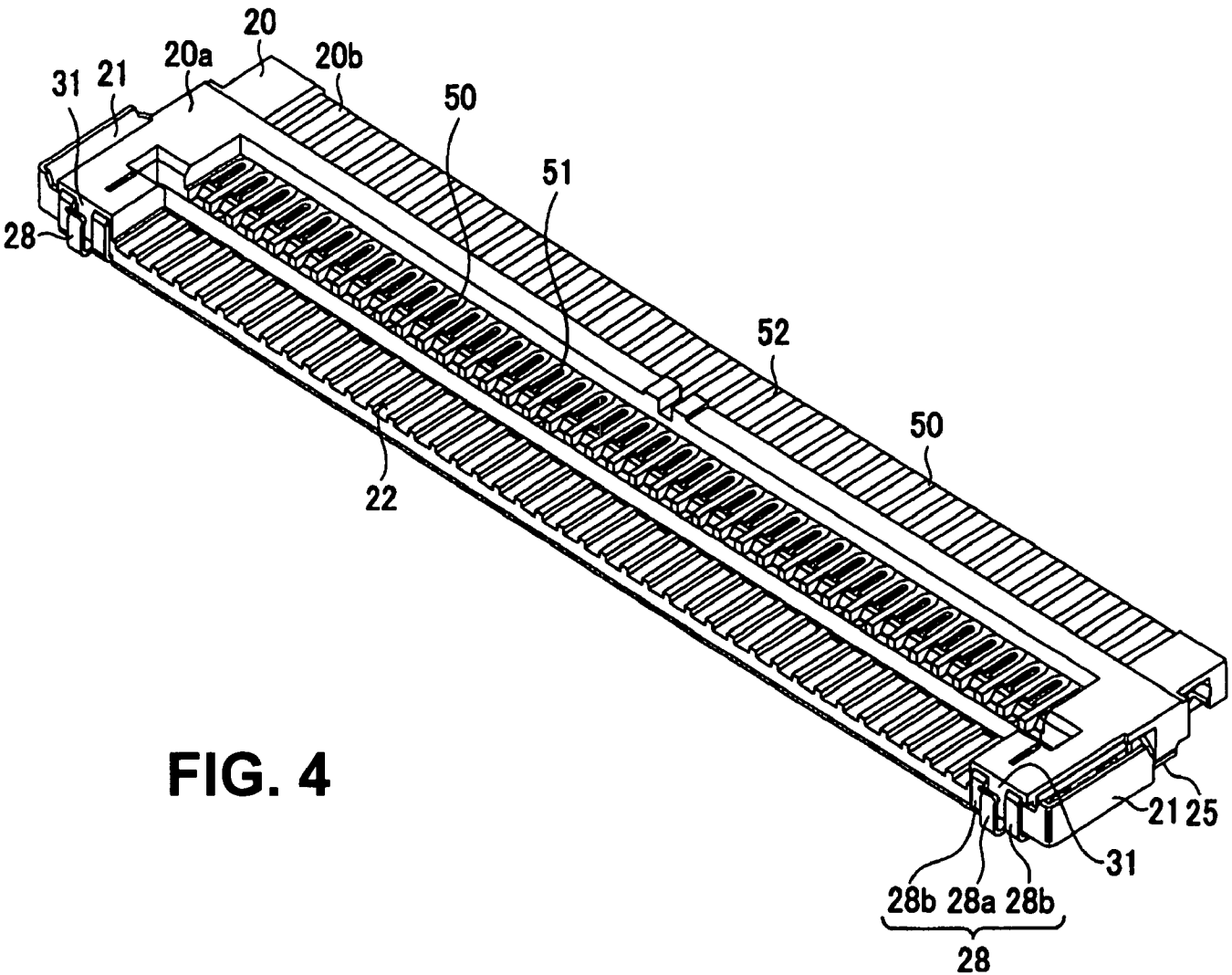
FIG. 4 is a perspective view showing the plug shown in FIG. 3 in a state that cables are removed.
Figure 7:
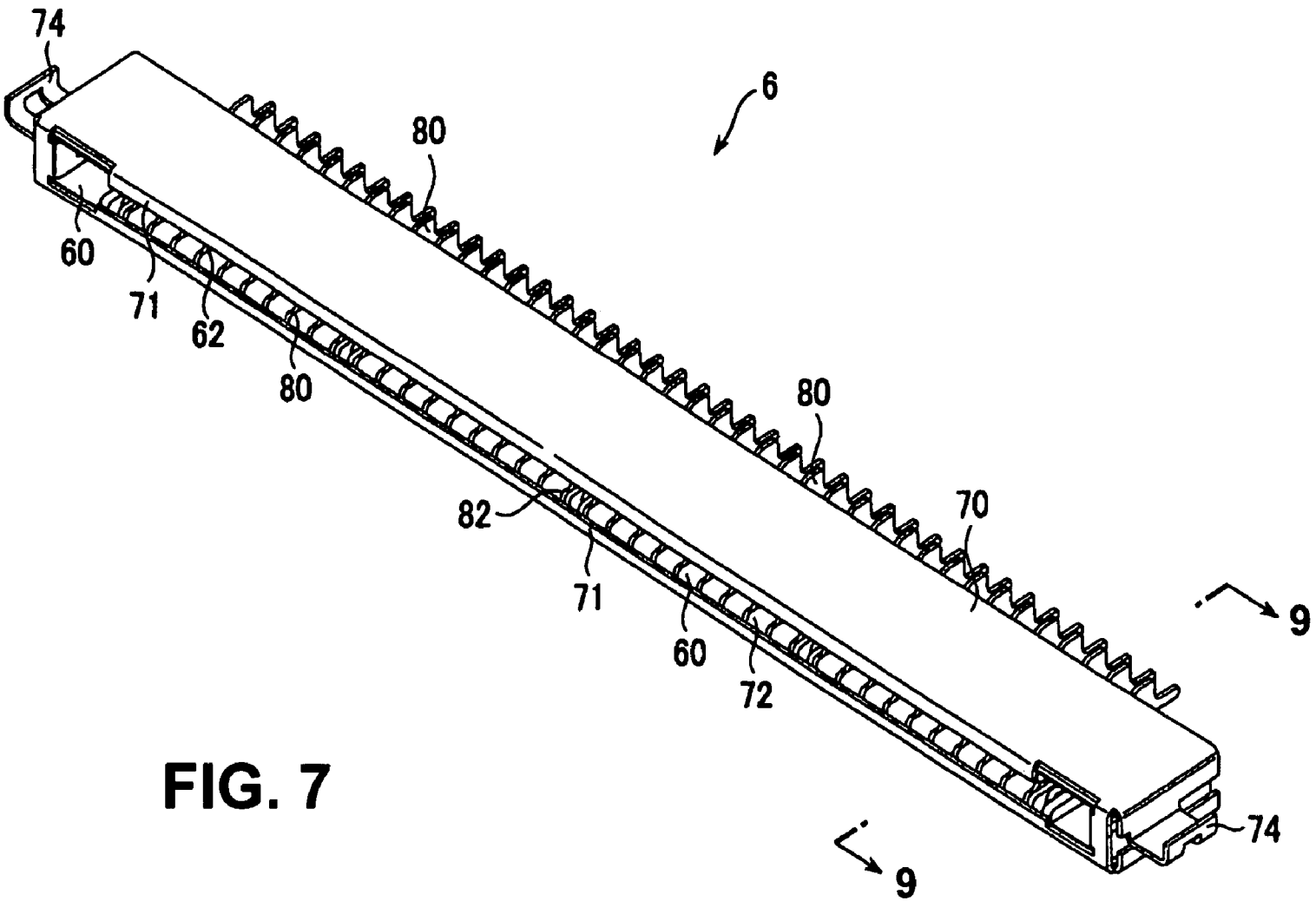
FIG. 7 is a perspective view showing an upper surface of a receptacle according to the embodiment of the present invention.
Figure 8:
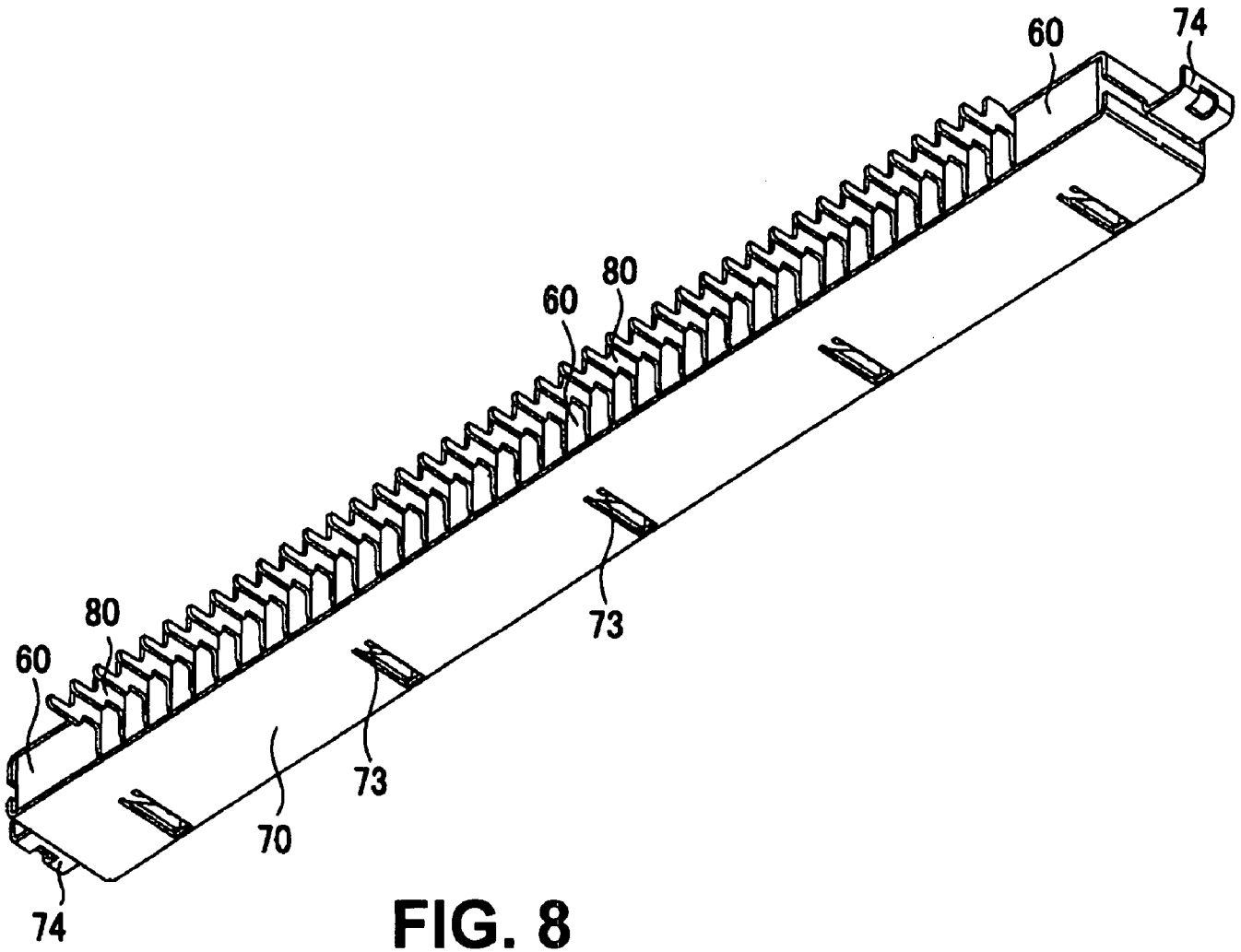
FIG. 8 is a perspective view showing a lower surface of the receptacle according to the embodiment of the present invention.
Figure 9:
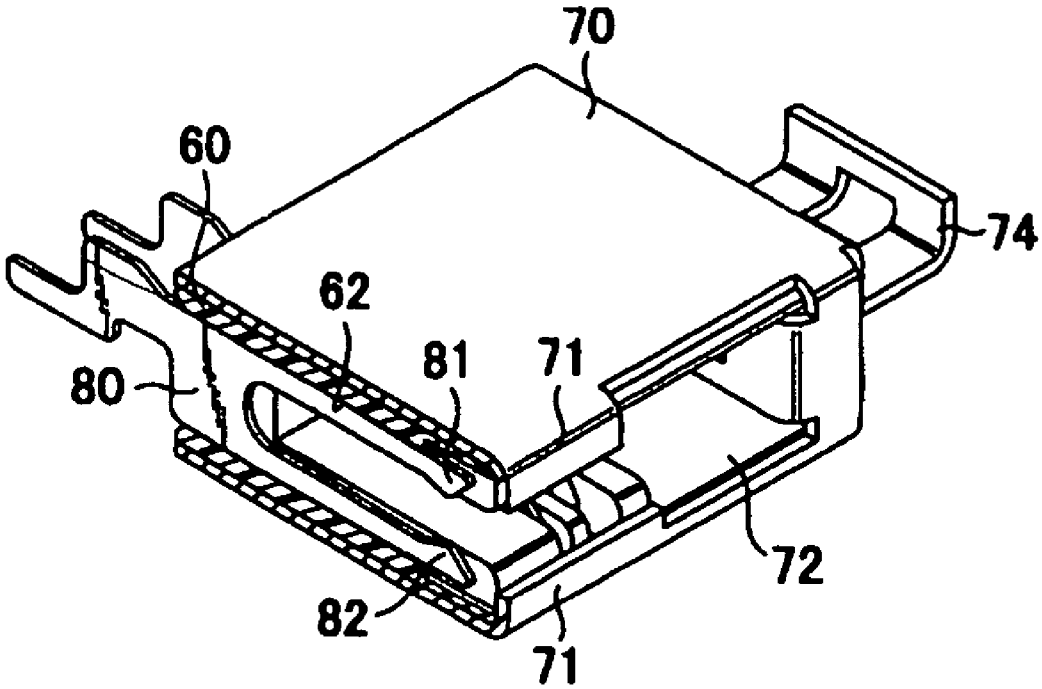
FIG. 9 is a sectional view taken along a line 9-9 in FIG. 7.

FIG. 1 is a perspective view showing an upper surface of a plug according to an embodiment of the present invention. FIG. 2 is a perspective view showing a bottom surface of the plug according to the embodiment of the present invention. FIG. 3 is a perspective view showing the plug shown in FIG. 1 in a state that an upper plug shell is removed. FIG. 4 is a perspective view showing the plug shown in FIG. 3 in a state that cables are removed. FIG. 7 is a perspective view showing an upper surface of a receptacle according to the embodiment of the present invention. FIG. 8 is a perspective view showing a lower surface of the receptacle according to the embodiment of the present invention. FIG. 9 is a sectional view taken along a line 9-9 in FIG. 7.

As shown in FIGS. 1-4, a plug 2 is mainly formed of a plug housing 20 made of a resin, a plug shell 40 made of metal that covers an exterior of the housing 20, and a plurality of male terminals 50 secured in the housing 20.

The housing 20 is formed of a rectangular casing 20*a*, and a fitting section 20*b* that protrudes from the casing 20*a* in a fitting direction to the receptacle. More specifically, a surrounding of the casing 20*a* is covered with the plug shell 40. The casing 20*a* has an opening 45 (also illustrated in FIGS. 10 and 11, described later) at least in the fitting direction to a receptacle 6.

The plug shell 40 has two parts, i.e., an upper part 24 and a lower part 25. Locking metal fittings 21, which can be integrally formed on the lower part 25, are provided on both sides of the plug shell 40. The locking metal fittings 21 do not have to be integrally formed on the plug shell 40, and can be formed as separate pieces. The lower part 25 has connecting sections 28*a*, 28*b* (see FIG. 3), which extend vertically along rear vertical walls 31 of the housing 20. While the contact sections 28*a* are arranged slightly away from the rear vertical walls 31, the contact sections 28*b* are arranged to contact with the rear vertical walls 31.

By pressing rear vertical walls 29 (see FIG. 1) of the upper part 24 into gaps between the contact sections 28*a* and 28*b*, the upper part 24 and the lower part 25 can be secured. In addition, in order to secure the upper part 24 to the lower part 25, connecting sections 26 that extend from both sides of the upper part 24 toward the lower part 25 and have fitting holes 27 are provided. By fitting corresponding protruding sections 32 of the lower part 25 to the fitting holes 27 of the connecting sections 26, the upper part 24 can be secured to the lower part 25.

A plurality of housing grooves 22 is provided in a row along the fitting direction of the plug 2 to the receptacle 6. A plurality of coaxial cables 10 is arranged in a row along the housing grooves 22. Shielded wires 12 are exposed near middle portions of the coaxial cables 10. The shielded wires 12 are connected to ground via the plug shell 40. On the other hand, cable core wires 11 are exposed at ends of the cables 10 and secured to male terminals 50 one-on-one.

Figure 5:
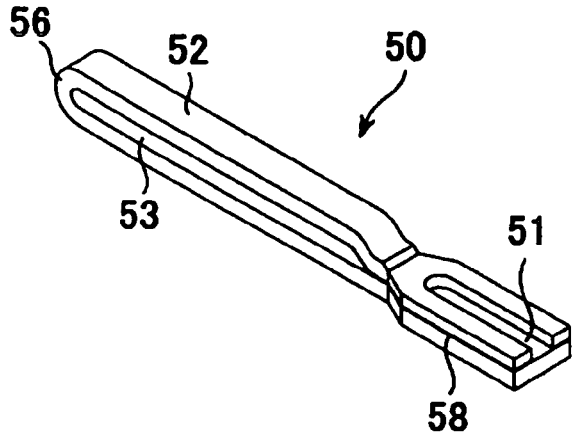
FIGS. 5(*a*) and 5(*b*) are enlarged views showing male terminals, respectively.
Figure 5:
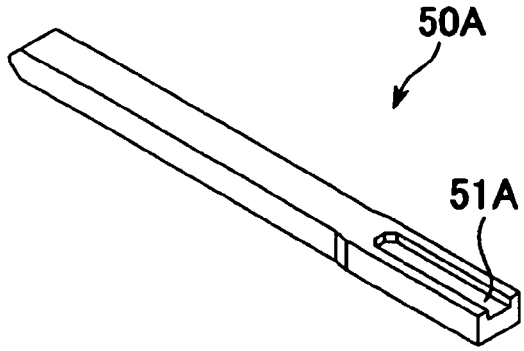

FIGS. 5(*a*) and 5(*b*) show enlarged views of the male terminals 50 and 50A. The male terminal 50 has an upper contact section 52 and a lower contact section 53 at its one end, which can contact with a receptacle terminal, and has a U-shaped core wire guide slit 51 at the other end, which is a depression to position the coaxial cable 10. The guide slit 51 is arranged in the plug housing, such that an opening of the U-shape is directed toward the inserting direction of the coaxial cable 10. By providing the contact sections 52 and 53 respectively on the upper and the lower sides of the male terminal 50, the male terminal 50 can contact with the receptacle terminal respectively on the upper and the lower sides in a height direction of the plug. With the constitution, the contact with the receptacle terminals can be more reliable.

The male terminal 50 shown in FIG. 5(*a*) is produced through folding. In other words, a metallic sheet that is punched into a specific shape is folded at a folding section 56, and the upper section 52 is away from the lower section 53 for a specific distance, and then connecting them at a connecting section 58. The U-shaped guide slit 51 to position the coaxial cable 10 is provided at the connecting section 58 of the upper section 52. After the male terminal 50 is folded, the ends of the upper contact section 52 and the lower contact section 53 are overlapped. Then, the cable core wire 11 is positioned in the guide slit 51. Accordingly, it is possible to connect the core wire 11 of the cable to the connecting section 58 of the upper contact section 52 and the lower contact section 53 at once. For a connecting method, pressure bonding, pressure welding, welding, and conductive adhesive can be employed as well as soldering.

As shown in FIG. 5(*b*), a male terminal 50A can be produced by one-piece molding or punching. A guide slit 51A of the male terminal 50A can be formed by punching at the time of one-piece molding, or by pressing.

Figure 6:
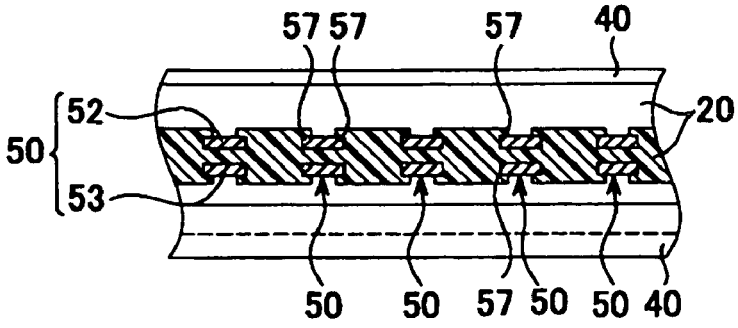
FIGS. 6(*a*) and 6(*b*) are sectional views showing fitting sections.
Figure 6:
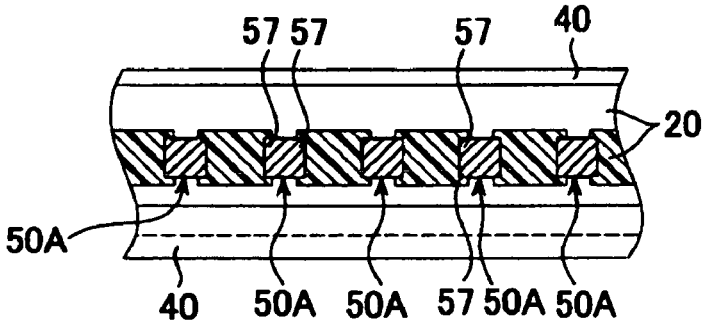

In the male terminal 50 produced by folding, strength thereof may be a problem, depending on a thickness of the metallic sheet. However, by integrally forming the male terminals 50 and the housing 20 as a single piece such that a gap between the upper contact section 52 and the lower contact section 53 is filled with a resin of the housing, the strength of the whole fitting portions can be improved. In addition, when the male terminals 50 and the housing 20 are integrally formed as a single piece, both sides 57 of the male terminals 50 in the fitting direction of the plug and the receptacle are embedded in the housing 20, thereby improving rigidity of the whole fitting portions. FIGS. 6(*a*) and 6(*b*) show the male terminals 50 and 50A, to which a resin is filled in according to the above-described method.

Securing the core wire 11 to the male terminal 50 can be done, for example, by placing a solder wire on the core wire 11 that is positioned in the guide slit 51 and then melting the solder by heat with a heater tip or a soldering iron. Even with such method, since the male terminals 50 are made of metal, the male terminals 50 are not melted by heat of the heater tip. Accordingly, it is possible to connect the core wires 11 without a risk of melting the molded parts.

Further, since the core wires 11 can be precisely positioned in the guide slits 51, the precision of positioning the core wires 11 can be improved. Here, since the core wires 11 can be positioned in the guide slits 51, the housing grooves 22 do not have to be provided.

Next, referring to FIGS. 7-9, a structure of the receptacle 6 will be described. The receptacle 6 mainly includes a receptacle housing 60 that has a fitting opening and is made of a resin, a metallic receptacle shell 70 that covers outside of the receptacle housing 60, and a plurality of female terminals 80 secured inside the housing 60.

The shell 70 has board-securing sections 74 at both sides thereof for connecting the receptacle to a board by soldering. At this time, the shell 70 covers around the receptacle 6 other than a fitting side to the plug and an opposite side of the fitting side. Here, at least the fitting opening to the plug 2 is opened. Bent sections 71 are formed at a fitting opening 72 of the shell 70 by bending upper and lower edges of the fitting opening 72 downward/upward toward inside the fitting opening 72. By providing the bent sections 71, durability of the receptacle for fitting the plug 2 to the receptacle 6 can be dramatically improved. With this structure, the contact between the plug and the receptacle can be also more reliable.

The receptacle housing 60 has a plurality of terminal grooves 62 along the direction of fitting the plug and the receptacle. The female terminals 80 are pressed in the terminal grooves 62 from a rear side of the housing 60 (an opposite side to the bent sections 71 in the plug-fitting direction).

One end of each of the female terminals 80 has a generally U-shape to accept the male terminal therein, and has an upper contact section 81 and a lower contact terminal 82 to respectively contact with the corresponding male terminal. In other words, the female terminal 80 has a two-point contact structure. By employing the two-point contact structure, the contact with the male terminal can be improved and more reliable.

Figure 10:
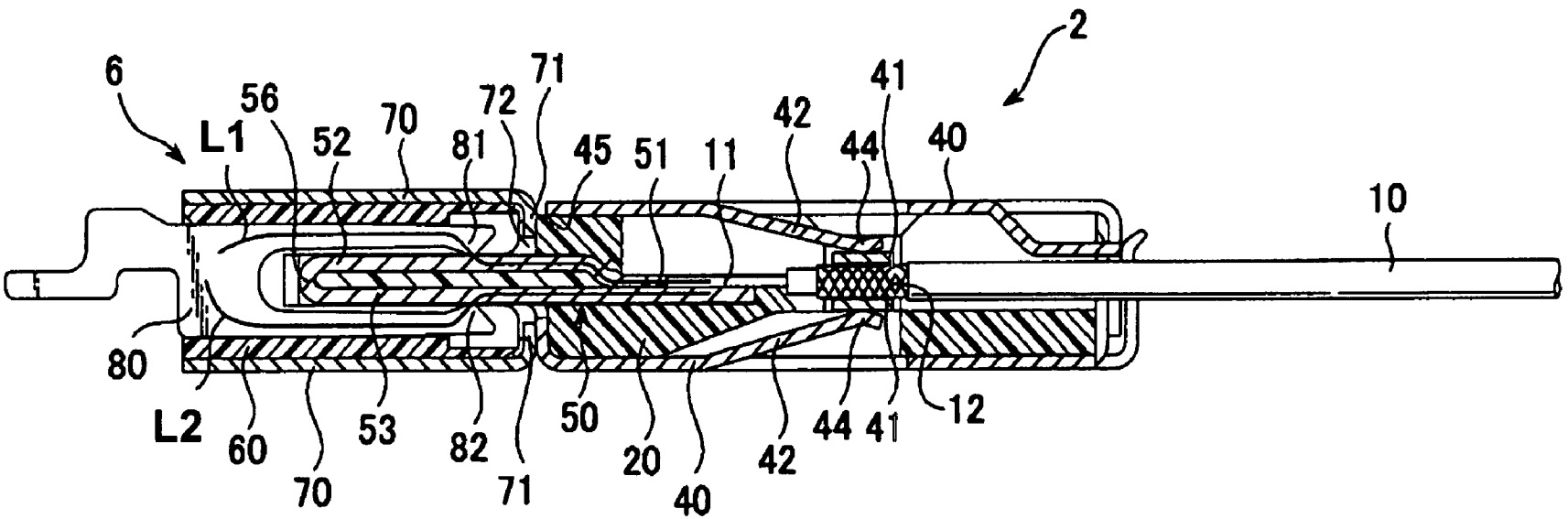
FIG. 10 is a sectional view taken along a line 10-10 in FIG. 1.
Figure 11:
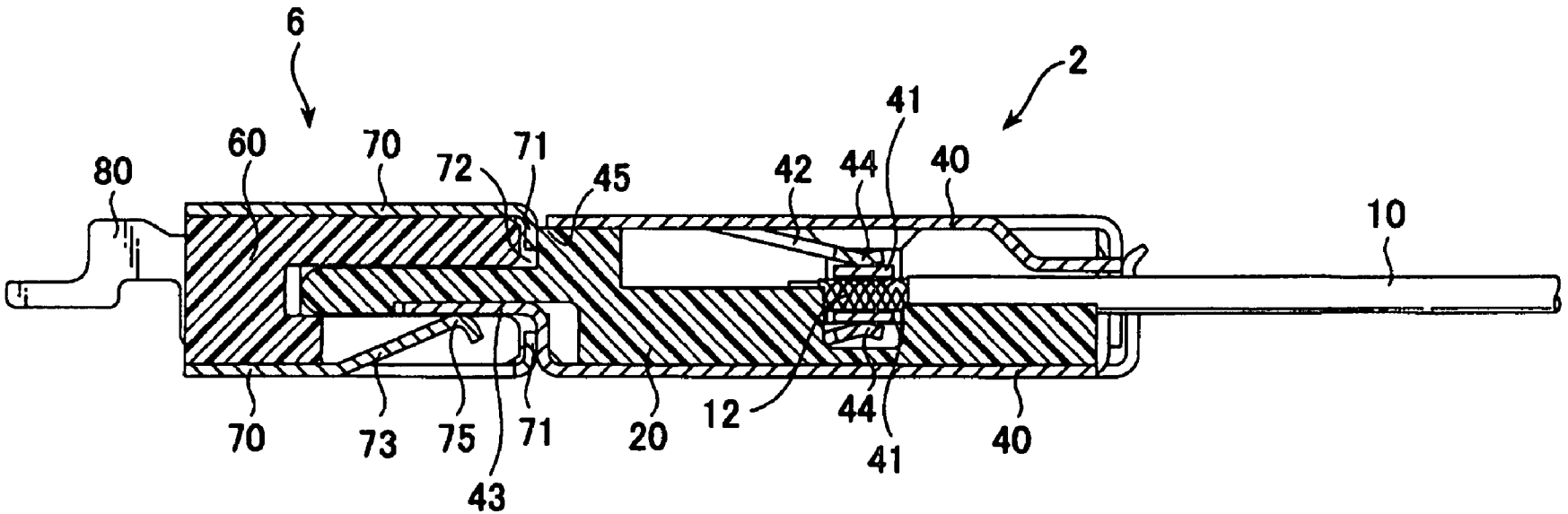
FIG. 11 is a sectional view taken along a line 11-11 in FIG. 2.
Figure 12:
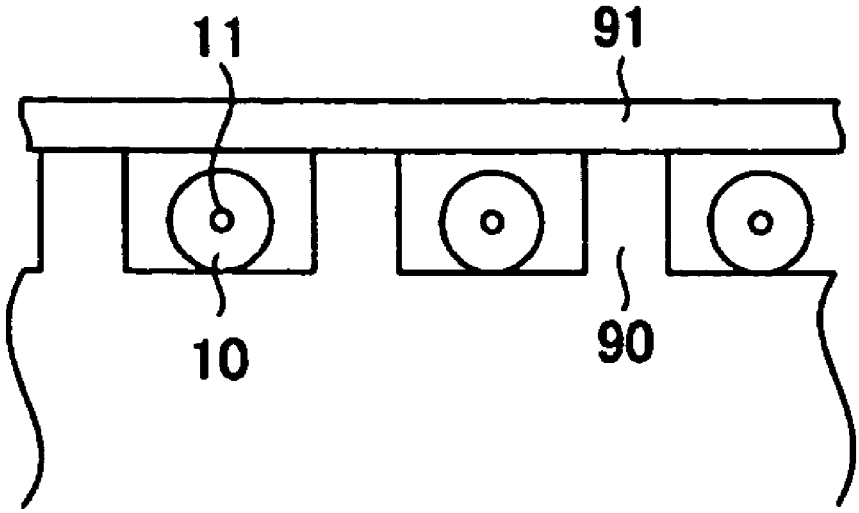
FIG. 12 PRIOR ART
FIG. 12 is a view showing a conventional electrical connector.

FIGS. 10 and 11 are sectional views showing the plug 2 and the receptacle 6 in a fitted state. FIG. 10 is a sectional view taken along a line 10-10 in FIG. 1. FIG. 11 is a sectional view taken along a line 11-11 in FIG. 2.

As shown in FIG. 10, at the time of fitting the plug 2 and the receptacle 6, the end (folded section 56) of the male terminal 50 in the plug 2 is inserted in the receptacle 6 through the fitting opening 72 of the receptacle 6. The upper contact section 52 and the lower contact section 53 of the male terminal 50 protrude from the opening 45 enough for insertion.

When the plug 2 and the receptacle 6 are fitted, each male terminal 50 is guided and inserted in between the upper contact section 81 and the lower contact section 82 of the corresponding female terminal 80 in the receptacle 6. As a result, the upper section 52 and the lower contact section 53 can respectively contact with the upper contact section 81 and the lower contact section 82. Since fitting to the female terminal 80 is guided by the end of the male terminal 50 as described above, the metallic terminals, i.e. the male terminals 50 and the female terminals 80, can contact to each other without contacting the molded parts with the metallic terminals as in a conventional connector, thereby eliminating influence from resin shavings, and improving contact reliability.

Here, when the male terminals 50 contact with the female terminals 80, the male terminals 50 have stable equal electrical path lengths. At each male terminal 50, the upper contact section 52 and the lower contact section 53 are connected at the connecting section 58. Accordingly, the electrical path lengths of the two paths, i.e., a path length L1 from the contact point between the upper contact section 52 and the upper contact section 81 to the connecting section 58 and a path length L2 from the contact point between the lower contact section 53 and the lower contact section 82 to the connecting section 58, can be set generally same in spite of the two-point contact with the female terminal 80. With this structure, the high-frequency properties can be satisfied.

As shown in FIG. 10, according to the constitution of the invention, in order to connect the shielded wire 12 of the coaxial cable 10 to ground, the plug shell 40 can be used. For example, parts of the respective upper and bottom surfaces of the plug shell 40 are cut and folded downward/upward to form free ends 44, so that the parts can be used as ground bar contact sections 42. A free end 44 of each ground bar contact section 42 can elastically contact with a ground bar 41 disposed on the shielded wire 12. Since the ground bars 41 contact with the shielded wires 12 of the core wires 11, a plurality of shielded wires 12 can contact to ground through the contact between the ground bar contact sections 42 and the ground bars 41.

In addition, according to the constitution of the invention, as shown in FIGS. 2, 8, and 11, the receptacle 6 can contact to ground through the contact between the receptacle shell 70 and the plug shell 40. To achieve this contact, for example, parts of the bottom surface of the receptacle 6 are folded upward toward inside the fitting opening 72 so as to form bent sections 73 having free ends 75. The bent sections 73 can be respectively formed at spaces between the female terminals 80. When the bent sections 73 are respectively arranged between spaces the female terminals 80, a size of the connector can be efficiently maintained as small as possible.

Corresponding to the bent sections 73, the plug shell 40 has extending sections 43 that extend toward the fitting side of the plug 2 and the receptacle 6. The extending sections 43 can be used as ground surfaces 43. When the plug 2 is fitted to the receptacle 6, the ground surfaces 43 of the plug 2 elastically contact with the free ends 75 of the bent sections 73. Through this contact, the board and the cable can connect to ground. In addition, since the shell 70 of the receptacle 6 has a function of connecting to ground while the female terminals 80 have the two-point contact, flatness can be maintained by simplifying the structure while maintaining the high-frequency properties.

Further, since the number of parts is small, an influence from pressing the plug 2 into the receptacle 6 can be reduced, and a dimension of the connector can be stabilized. Here, the bent sections 73 can be formed not only in the bottom surface of the receptacle 6, but can be formed in other place, e.g. on the upper surface or the both surfaces. Also, any number of the bent sections can be formed. Similarly, the corresponding ground surfaces 43 of the plug 2 can be arranged between the plug terminals 50 on the bottom surface, and can be formed on any place, such as on the upper surface and the both surfaces.

The disclosure of Japanese Patent Application No. 2005-261163, filed on Sep. 8, 2005, is incorporated in the application.

While the invention has been explained with reference to the specific embodiments of the invention, the explanation is illustrative and the invention is limited only by the appended claims.

What is claimed is:

1. An electrical connector to be connected to a cable and a mate connector, comprising:

a first housing having a casing with a substantially rectangular shape and a fitting section protruding from the casing by a first length in a first direction that the electrical connector is fitted to the mate connector, said casing extending laterally in a second direction perpendicular to the first direction, said fitting section extending along the second direction over a substantially whole lateral length of the casing;

a first shell covering the casing, said first shell including a portion extending in the first direction that the electrical connector is fitted to the mate connector, said portion having a ground surface arranged on the fitting section as a ground terminal for grounding with a shell of the mate connector; and a first terminal arranged in the fitting section so that the fitting section sandwiches the first terminal, said first terminal having an upper first contact section at an upper side of one end thereof and a lower first contact section at a lower side of the one end both for contacting with a terminal of the mate connector, said first terminal having a connecting section at the other end thereof for connecting with a core wire of the cable such that a distance from the upper first contact section to the connecting section is substantially same as a distance from the lower first contact section to the connecting section.

2. The electrical connector according to claim 1, further comprising a guide slit at the connecting section for positioning the core wire of the cable.

3. The electrical connector according to claim 1, wherein said first terminal includes a folded section at the one end.

4. The electrical connector according to claim 1, wherein said first terminal is formed of an integrated single piece.

5. The electrical connector according to claim 1, wherein said upper first contact section and said lower first contact section are formed in a plate shape and arranged to form a gap therebetween so that a part of the first housing is accommodated in the gap when the first terminal and the first housing are integrally formed.

6. The electrical connector according to claim 1, wherein said first terminal include both side edges relative to the first direction that the electrical connector is fitted to the mate connector so that the both side edges are embedded in the first housing when the first terminal and the first housing are integrally formed.

7. The electrical connector according to claim 1, wherein said first terminal is arranged in the fitting section so that the first terminal protrudes from the casing by the first length in the first direction.

8. The electrical connector according to claim 1, wherein said ground terminal is arranged inbetween the first terminal.

* * * * *